US005191982A

United States Patent [19]

Tong

[11] Patent Number: 5,191,982

[45] Date of Patent: Mar. 9, 1993

[54] BEAN SIFTING DEVICE

[76] Inventor: Hsu C. Tong, No. 63-1, Kuei Sui St., Taipei, Taiwan

[21] Appl. No.: 884,717

[22] Filed: May 15, 1992

[51] Int. Cl.[5] ..... B03B 5/28

[52] U.S. Cl. ..... 209/155; 209/157; 209/173; 209/211; 241/20; 241/79.1

[58] Field of Search ..... 209/132, 155, 156, 157, 209/173, 207, 211; 241/20, 79.1

[56] References Cited

U.S. PATENT DOCUMENTS

| | | | |
|---|---|---|---|
| 2,450,398 | 9/1948 | Sanders | 209/155 |
| 3,471,014 | 10/1969 | Fuchs | 209/155 |
| 3,869,559 | 3/1975 | Clark | 209/173 X |
| 3,897,215 | 7/1975 | Davidson, Jr. et al. | 241/79.1 X |
| 4,478,710 | 10/1984 | Smucker et al. | 209/17 |

FOREIGN PATENT DOCUMENTS

| | | | |
|---|---|---|---|
| 2211763 | 7/1989 | United Kingdom | 209/155 |

*Primary Examiner*—Joseph E. Valenza
*Assistant Examiner*—Tuan N. Nguyen
*Attorney, Agent, or Firm*—W. Wayne Liauh

[57] ABSTRACT

A bean sifting device which comprises a water-supply assembly, a water tank, a floating-sifting tank, and a supporting frame; the water-supply assembly can have water in the water tank to be forced by use of a pump in the water-supply assembly to flow into the floating-sifting tank through a pipe and slanting water outlet; the water would generate a whirl by use of a round and curved bottom and the wall of the floating-sifting tank; as a result of the effect of a centrifugal force and the different specific gravity gravity of beans, the bad beans will float in the upper water in the tank, and will flow into the water damping area to pass through a slot hole, a round passage and an exhausting port; finally, the bad beans will flow in a sieve basket so as to fulfill a purpose of sifting beans in different classes automatically.

1 Claim, 3 Drawing Sheets

BEAN SIFTING DEVICE

BACKGROUND OF THE INVENTION

Before a bean to sprout, the sifting process for good beans is a very important step, i.e., every kinds of beans has to be elected with a sifting step before sprouting so as to wash out the bad beans, which may spoil the sprouting process or have bed sprouts. The conventional sifting method for beans is usually done manually, i.e., the beans are first soaked with water in a suitable container for a given period of time; then, a water pipe is inserted to the bottom of the container to provide a fast and strong water stream in the container so as to produce a whirl for washing the beans; as a result of a centrifugal force and gravity effect, the smaller and premature beans or dead beans that have less weight will float on water surface; then, a big spoon or a water pipe is used to skim or to attract the floating bad beans so as to divide beans into different classes and to obtain better sprouts.

Unfortunately, the aforesaid manual sifting method is rather slow, wasting time and manpower; further, the aforesaid washing and attracting steps done manually are merely by experience, and therefore the operation tolerance is ranging from 7-8%, as a result, a poor sprouting result would cause; in other words, it is deemed wasting time, manpower and money to the people of such business, and not conforming to economic principal.

SUMMARY OF THE INVENTION

This invention relates to a bean sifting device, which comprises a water-supply assembly, a water tank, a floating-sifting tank, and a supporting frame. A pump in the water-supply assembly provides a strong water stream to flow through a pipe and to the floating-sifting tank, in which a water whirl with beans is produced. Since different beans have different specific gravity, the beans will be divided into different floating levels. The floating beans will flow into a water damping area formed with a damping plate and a sliding plate, and then flow through a slot hole to a round passage, and finally to a sieve basket. The present invention can automatically sift beans in a simple and fast manner; the present invention not only can save time (taking only ¼ of manual operation time), and manpower, but also has a simple structure to facilitate operation, and the error tolerance of operation can be reduced under 1/100, i.e., a best sifting result can be obtained.

DETAILED DESCRIPTION

Figure 1:
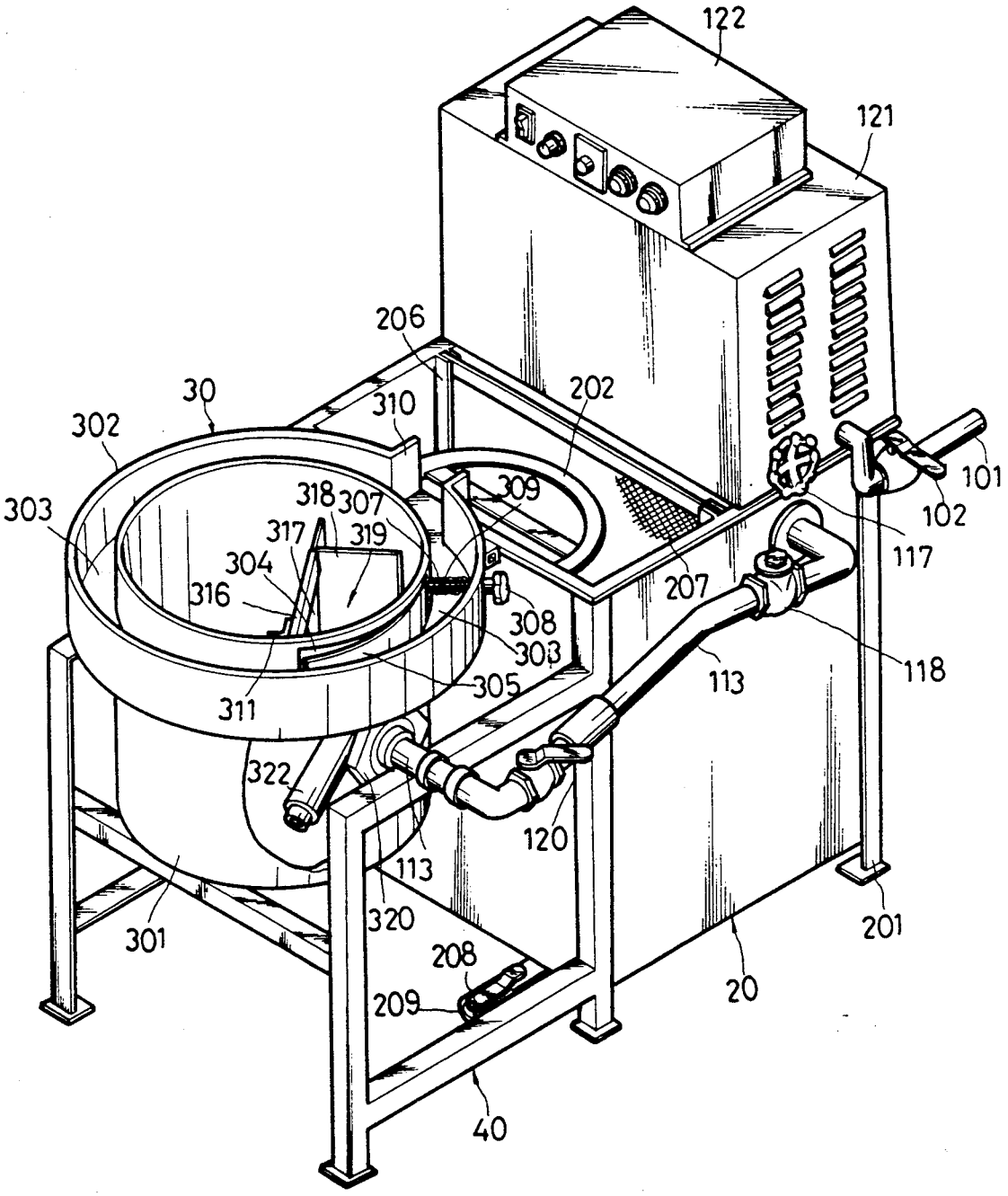
FIG. 1 is a perspective view of an embodiment according to the present invention.
Figure 2:
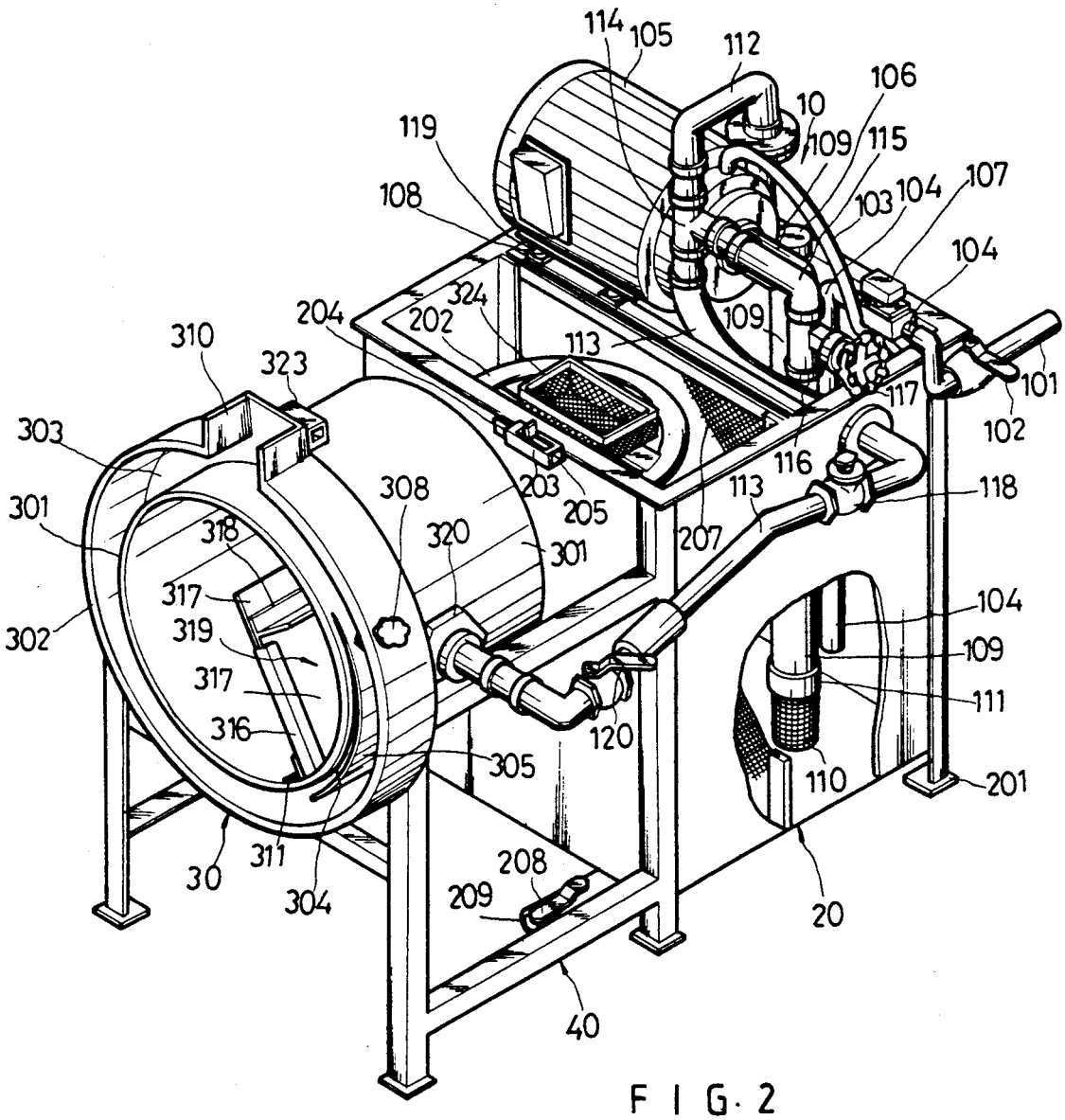
FIG. 2 is a perspective view of the present invention upon the body casing thereof being removed.

FIG. 1 is a perspective view of an embodiment according to the present invention, which comprises a water-supply assembly 10 for supplying and controlling water supplied (as shown in FIG. 2), a water tank 20 for storing water, a flouting-sifting tank 30 for screening beans, and a supporting frame 40 for supporting the floating-sifting tank. The water-supply assembly 10 is fixedly fastened the upper right of the water tank 20.

The water flows in from a water inlet 101, and then passes through a valve 102, pipes 103 and 104; the smaller pipe 103 is connected with a pump 105 to let water fill in the blades of the pump so as to prevent the pump 105 from running idly, and to let the pump 105 draw water upon being started. The larger pipe 104 is connected into the water tank 20. The volume of water flowed into pipe 104 is tested with a water level detector 106, and then a water level controller 107 mounted on pipe 104 will be used for turning on or off the pipe 104 so as to have the water tank 20 maintained at an appropriate water level. The pump 105 is mounted, by means of a supporting frame 108, above the water tank 20. Between the bottom of the pump 105 and the supporting frame 108,. there is a pad 119 to absorb shock. The pump 105 is used for pumping water out of the water tank 20 through a pipe 109 and a netting filter 110. A one-way valve 111 is installed between the lower end of pipe 109 and the netting filter 110. The water pumped out of the water tank will flow through the netting filter 110, the one-way valve 111, the pipe 109 to enter the pump 105, where the water is forced to flow out at a high pressure through pipes 112 and 113, a water outlet 322 in the lower part of the floating-sifting tank 30, and finally flows into the tank 30. A T-joint pipe 114 is installed between pipe 112 and pipe 113 for connecting a pipe 115, of which one pipe end 116 is mounted with a value 117 for regulating the water volume and air in pipe 113. A one-way valve 118 is installed in pipe 113 to have the water only flowed into the floating-sifting tank 30; the pipe 113 is also installed with a valve 120 for controlling water to flow into the floating-sifting tank 30.

The water tank 20 is rectangular cubic tank, of which the bottom is mounted with supporting legs 201. A supporting frame 202 is furnished above and beside the wall of the floating-sifting tank 30 for mounting a bad-bean sieve basket. The top edge of the water tank 20 is installed with a square pipe 203 with a sliding bolt 204 therein; the sliding bolt 204 has a push handle 205, whereby the sliding bolt 204 can be inserted in a square pipe 323 on the floating-sifting tank 20 so as to lock the tank 20 in place to prevent the tank from rotation and turnover. Both front and rear wall of the water tank 20 are furnished with two U-shaped sliding grooves 206 respectively; each such sliding groove is inserted with a sieve 207. The lower part of the water tank 20 is mounted with a valve 208 to control a water outlet 209.

Figure 3:
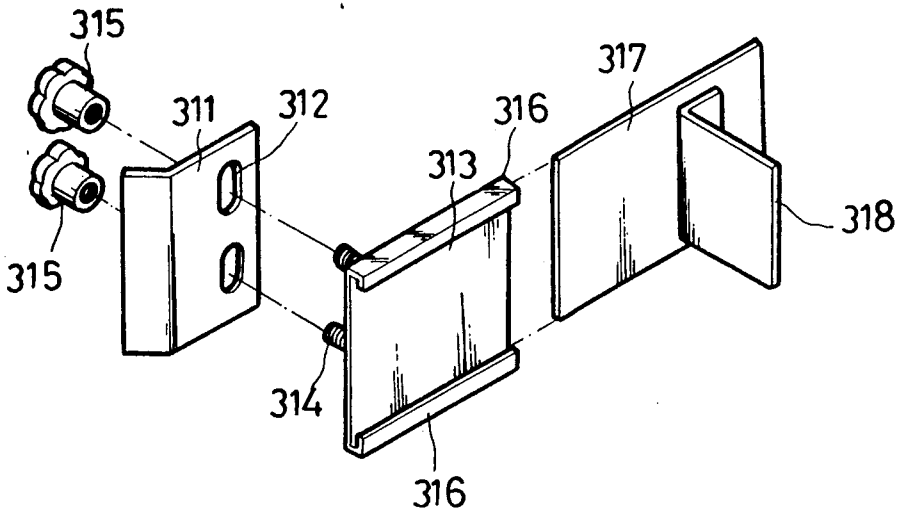
FIG. 3 is a perspective view of a damping assembly in the present invention.

The floating-sifting tank 30 is fixedly connected with the left side of the water tank 20 by means of a supporting frame 40. The tank body 301 is a round member, of which the bottom is a curved part; the top of the tank 30 has an outer wall 302 with a larger diameter; a round passage 303 is furnished on the top of the tank body 301; the upper part of the tank body 301 has a narrow slot hole 304 being in communication with the round passage 303. The front of the slot hole 304 is furnished with a curved movable plate 305 similar in shape to the slot hole 304; one end of the movable plate 305 is connected with a screw bolt 307, of which one end is fastened with a knob 308 mounted outside the outer wall 302. A part of the screw bolt 307 between the movable plate 305 and the outer wall 302 is mounted with a spring 309. When the knob 308 is turned, the screw bolt 307 will move axially so as to actuate the movable plate 305 for controlling the contact space between the movable plate 305 and the slot hole 304 (i.e., the opening size of the slot hole 304). The outer wall 302 extends to the water tank 20 to form an exhausting port 310 for bad beans. The exhausting port 310 is located over the supporting frame 202) of the water tank 20. The inner wall of the tank body 301 of water tank 20 is mounted with a fastening bracket 311 (as shown in FIG. 3) with two oblong holes 312. A sliding channel plate 313 with two screw bolts 314 on the back side thereof is fastened to the fastening bracket 311 by means of the two screw bolts 314 engaged with the two oblong holes 312 and two knobs 315. The vertical position of the sliding channel plate 313 can be adjusted by loosening the two knobs 315. The other side of the sliding channel plate 313, (i.e., one side facing the slot hole 304 of the tank body 301) has two U-shaped channels 316 on the upper and lower edges thereof for receiving a rectangular sliding plate 317, which is movably mounted in the U-shaped channels 316. One side of the sliding plate 317 (i.e., the side being adjacent to the slot hole 304) is mounted with a damping plate 318, of which the height is slightly lower than that of the sliding plate 317 so as to maintain a suitable distance between the top and bottom of the damping plate 318 and that of the sliding plate 317. When the sliding plate 317 is moved along the sliding channel plate 313, the dimensions of the water damping area 319 formed with the sliding channel plate 313, the damping plate 318 and the tank body 301 will be varied. Both front and rear sides of the tank body 301 are pivotally mounted with two bearing blocks 320 which are fixedly attached to a supporting frame 40, but the tank body 301 is slightly inclined to the water tank 20. The tank body 301 can be turn backwards for pouring out something by using the bearing blocks 320 as a fulcrum. The front bearing block 320 is mounted with a pipe 113 of the water-supply assembly 10 through the lower part of the tank body 301 with a water outlet 322, which has a given slanting angle. A square pipe 323 is furnished under the exhausting port 310 of the floating-sifting tank 30, and it is aligned with a square pipe 203 on the water tank 20. When the push handle 205 of a sliding bolt 204 is pushed out of the square pipe 203, the sliding bolt 204 will be inserted in the opposite square pipe 323 to cause the floating-sifting tank 30 to be fixedly attached to one side of the water tank 20. The floating-sifting tank 30 may be turned leftwards (i.e., to turn in opposite direction of the water tank 20) for pouring out something by pulling the push handle 205 to cause the sliding bolt 204 to move out of the square pipe 323; then, the floating-sifting tank 30 will be able to turn over with the bearing block 320 as its fulcrum.

In order to make the present invention having a better appearance, the water-supply assembly 10 is covered with a body casing 121 (as shown in FIG. 1), on which an electric control box 122 is mounted; the control box 122 includes circuits of control switches, a motor-starting switch, a motor rotation time and water level detector, and a water level controller; since all the aforesaid control circuits are well-known techniques, they are not described in detail as not being included in the claims.

To operate the present invention, water is supplied first through the water inlet 101 of the water-supply assembly 10; the valve 102 is turned to have pipe 103 become a through pipe, and the water will flow through pipe 103, and into the pump 105 to have all pump blades in water; then, the valve 102 is turned to have pipe 103 closes, and to have pipe 104 opened for pouring water into the water tank 20. As soon as the water level in the water tank 20 reaches a suitable height, the water lever detector 106 will send a signal to the water level controller 107, which will have the pipe 104 closed immediately so as to maintain the water tank 20 having a suitable level without overflowing out of the water tank 20. A given volume of beans soaked may be poured into the tank body 301 of the floating-sifting tank 30 (according to the present invention, one batch of 40 kg of beans can be processed once). When the pump 105 is started to run, water in water tank 20 will be pumped out through the netting filter 110, the one-way valve 111 and pipe 109 to flow into the pump 105; then, a high-pressure water will be sent out of the pump 105 to flow through pipe 113 and valve 120 for controlling the water volume flowing into the floating-sifting tank 30 via water outlet 322. Between pipe 112 and 113, there is a T-joint pipe 115 with a valve 117. By means of the valve 117, water flowing in pipe 112 can be controlled to flow through the T-joint pipe 114, the pipe 114, which is connected with a pipe 115, the pipe end 116, and finally into water tank 20; therefore, the water volume flowing through pipe 113 can be controlled; simultaneously, the water flowed, through pipe end 116, into the water tank 20 would generate a plurality of air bubbles, which can facilitate beans in the floating-sifting tank to float off.

When water flows into the tank body 301 through the water outlet 322, the water would gush to the beans therein to form a whirling water stream with floating beans as a result of the water outlet 322 being set at an angle, and the bottom of the tank body 301 having a curved surface. Further, as a result of a centrifugal force and the different specific gravity among beans (generally, premature and bad beans would have a lower specific gravity), bad beans would float of in the upper water stream, and will flow, as a result of centrifugal force, into the space formed with the sliding plate 317, the damping plate 318 and the slot hole 304, and then flow, through the slot hole 304, out of the tank body 301 into a round passage 303; finally, such bad beans will flow out of an exhausting port 310, and into a sieve basket 324; simultaneously, the water stream that carries the bad beans will flow through a sieve 207 back into the water tank 20, wherein the water may be reused through the pump 105 of the water-supply assembly 10. Since the sliding channel plate 313 can be adjusted by moving up or down, the sliding plate 317 can be moved backwards or forwards to vary the dimensions of the water-damping area 319, and the movable plate 305 can be move with respect to the slot hole 304, the bean sifting device according to the present invention can be set for screening beans into different classes so as to provide the best screening result. For instance, the sliding channel plate 313 can be adjusted up and down; the damping plate 318 can be adjusted for a given screening class; the water damping area 319 can be adjusted for varying the attracting force to the water; if the water damping area 319 is reduced, the attracting force to the beans in the deeper tank body 301 portion will be increased; if the water damping area 319 is reduced, the attracting force to the beans in the deeper tank body 301 portion will be increased; if the water damping area 319 is reduced, the attracting force to the beans in the deeper tank the water damping area 319, i.e., to vary the distance between the plate 305 and the slot hole 304. If the space between the plate 305 and the slot hole 304 is smaller, the floating force of the beans will be increased, otherwise the floating force will be reduced.

The sifting device according to the present invention can process about 40 Kg of beans once, i.e., it can process about four times of volume as that of a conventional sifting device, which is capable of processing about ten kg of beans within 20 minutes; the present invention takes only five minutes to process about 40 kg of beans; further, the sifting tolerance of the present invention is merely about 1%, while the sifting tolerance of a conventional sifting device is ranging from 7–8%. Moreover, the water used in the present invention can be used repeatedly, and after each process cycle, 10% water thereof should be replenished. In the conventional sifting device, the water used in the conventional sifting device is usually exhausted completely, and it is deemed of wasting water resources.

I claim:

1. A bean sifting device comprising:

water-supply assembly being fixedly mounted on upper right side of a water tank, and having a water inlet for supplying water therein through a valve connected two pipes, of which a smaller pipe being connected into a pump and blades therein, while a larger pipe being connected into a water tank, and said larger pipe being mounted with a water level controller which is to control on or off of said pipe in accordance with signal from a water level detector; said pump being mounted over said water tank by means of a supporting frame; the front end of said pump having a pipe extended into a lower part of said water tank, and said pipe being mounted with a netting filter and a one-way valve above said netting filter; said pump having a pipe extended in a floating-sifting tank with a water outlet; said pipe having a shunt pipe mounted between said pump and said water tank, and opening of said pipe being positioned above the water level in said water tank, and said pipe having a valve; said pipe connected with said floating-sifting tank being mounted with a valve and a one-way valve to limit water to flow only in said floating-sifting tank; said water-supply assembly being covered with a body casing, on which an electric control box being mounted;

said water tank being a rectangular cubic tank supported with supporting legs; a supporting frame being attached to an inner wall of said water tank for receiving a sieve basket; both front and rear inner wall of said water tank being furnished with sliding grooves respectively for inserting sieves respectively; the bottom of said water tank being furnished with a water outlet controlled by means of a valve;

said floating-sifting tank being pivotally mounted with bearing blockets on a supporting frame that is fixed beside said water tank; said floating-sifting tank being round-shaped tank slightly inclined towards said water tank; said floating-sifting tank also being able to turn leftwards (i.e., opposite to said water tank) for pouring off one class of beans; bottom of said floating-sifting tank being a curved one, and an outer wall with a larger diameter bein mounted around said floating-sifting tank in concentric-circle manner to form into a round passage; top edge of said floating-sifting tank having a slot hole being in communication with said round passage; a curved movable plate similar in shape to said slot hole being mounted in front of said slot hole, and said movable plate being attached with a screw bolt which is mounted with a spring; one end of said screw bolt being fastened with a knob on said outer wall; said screw bolt able to move axially upon said knob being turned so as to adjust space between said slot hole and said movable plate; said outer wall having an exhausting port extended to and over said supporting frame on said water tank; a fastening bracket being attached to inner wall of said tank body, and said fastening bracket having two oblong holes for receiving two screw bolts on a rectangular sliding channel plate, and then two knobs being fastened to said two screw bolts respectively; said sliding channel plate fastened to said fastening bracket able to be adjusted up and down upon loosening said two knobs; said sliding channel plate being mounted nearing said slot hole and having two U-shaped channels for receiving a sliding plate which has a damping plate on one side thereof; said damping plate being slightly smaller than said sliding plate; moving said sliding plate able to vary the dimensions of a water damping area formed with said sliding channel plate, said damping plate and said tank body; said tank body being slightly inclined to said water tank; a pipe of said water-supply assembly passing through a front bearing block to extend in the lower part of said tank body with a water outlet, which is fixed in place at an angle; a locking means being furnished under the exhausting port of said floating-sifting tank so as to retain said floating-sifting tank beside said water tank;

said water-supply assembly able to draw out water with said pump to flow through said netting filter, said one-way valve, a pipe and finally to said pump, from which a pressurized water flowing through a pipe, a valve and a water outlet to said floating-sifting tank; said water outlet being set at an angle and bottom of said tank body being round and curved in shape, which can cause water flowed in to generate a whirl so as to have beans having a light specific gravity become floating in upper water and to flow into said water damping area which is formed with said sliding plate, said damping plate and said slot hole, and then flowing to outside of said tank body, and through said round passage, and to said exhausting port and finally to a sieve basket on said supporting frame of said water tank so as to automatically sift beans into different classes.

* * * * *